US010205221B2

(12) United States Patent
Fan et al.

(10) Patent No.: US 10,205,221 B2
(45) Date of Patent: Feb. 12, 2019

(54) MULTIBAND ANTENNA STRUCTURE AND WIRELESS COMMUNICATION DEVICE USING THE SAME

(71) Applicant: Chiun Mai Communication Systems, Inc., New Taipei (TW)

(72) Inventors: Szu-Chi Fan, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 451 days.

(21) Appl. No.: 14/980,737

(22) Filed: Dec. 28, 2015

(65) Prior Publication Data

US 2016/0352013 A1 Dec. 1, 2016

(30) Foreign Application Priority Data

May 29, 2015 (CN) ..... 2015 1 0285623

(51) Int. Cl.

| | |
|---|---|
| ***H01Q 5/10*** | (2015.01) |
| ***H01Q 1/24*** | (2006.01) |
| ***H01Q 9/04*** | (2006.01) |
| ***H01Q 13/10*** | (2006.01) |
| ***H01Q 5/371*** | (2015.01) |

(52) U.S. Cl.

CPC ..... *H01Q 1/243* (2013.01); *H01Q 5/371* (2015.01); *H01Q 9/0421* (2013.01); *H01Q 13/10* (2013.01)

(58) Field of Classification Search

CPC ..... H01Q 5/10; H01Q 1/243; H01Q 1/38; H01Q 13/10; H01Q 5/371; H01Q 5/50; H01Q 9/0421

See application file for complete search history.

(56) References Cited

U.S. PATENT DOCUMENTS

2013/0135157 A1* 5/2013 Tsou ..... H01Q 1/2266 343/702

* cited by examiner

*Primary Examiner* — Graham Smith
*Assistant Examiner* — Jae Kim
(74) *Attorney, Agent, or Firm* — ScienBiziP, P.C.

(57) ABSTRACT

A multiband antenna structure includes a matching portion, a first radiator, and a second radiator. The first radiator and the second radiator extend from a first edge of the matching portion. The second radiator and the matching portion resonate a first mode. The first radiator and the matching portion resonate a second mode. The slot, the first radiator, and the matching portion resonate a third mode. The second radiator includes a first connection section, a second connection section, a third connection section, and a fourth connection section. The first connection section is perpendicularly connected to a first end of the first edge. The second connection section is perpendicularly connected to the first connection section and extends parallel to the first edge. The third connection section is parallel to the first connection section. The fourth connection section is parallel to the second connection section.

14 Claims, 8 Drawing Sheets

MULTIBAND ANTENNA STRUCTURE AND WIRELESS COMMUNICATION DEVICE USING THE SAME

FIELD

The subject matter herein generally relates to antenna structures, and particularly to a multiband antenna structure, and a wireless communication device using the same.

BACKGROUND

Wireless communication devices such as smartphone and tablet PC are becoming increasingly popular, and some of them use one or several metallic members to form its partial housing for enhancing structural strength and improving aesthetics. However, the metallic member may deteriorate the performance of an antenna built inside the housing. Therefore, there is a need for designing an antenna structure with good performance within a metallic housing.

BRIEF DESCRIPTION OF THE DRAWINGS

Implementations of the present technology will now be described, by way of example only, with reference to the attached figures.

DETAILED DESCRIPTION

Figure 1:
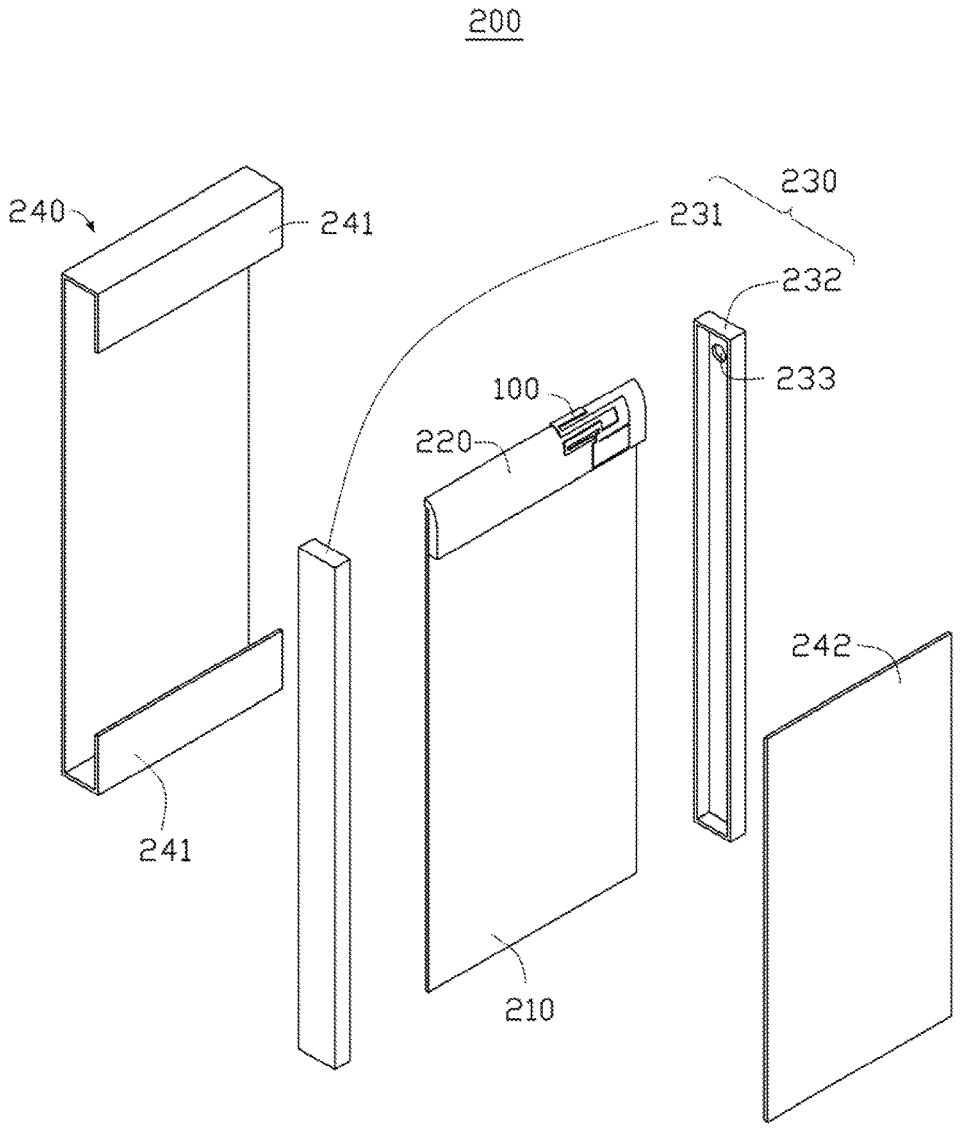
FIG. 1 is a diagrammatic view of a wireless communication device employing an antenna structure, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

FIG. 1 illustrates an embodiment of a wireless communication device 200 employing an antenna structure 100, according to an exemplary embodiment. The wireless communication device 200 can be a smartphone, a tablet PC, or a smart camera with GPS/WIFI function, for example (details not shown).

The wireless communication device 200 further includes a baseboard 210, a holder 220, a metallic frame 230, and a cover 240.

The baseboard 210 may be a printed circuit board (PCB) and is latched by the metallic frame 230. Thus, the metallic frame 230 can be grounded via the baseboard 210. The baseboard 210 further defines a keep-out-zone 211 and includes a plurality of electronic components. The keep-out-zone 211 is disposed at an end of the baseboard 210, and the antenna structure 100 is located above a side of the keep-out-zone 211. The keep-out-zone 211 further defines a notch 2112 at one end thereof. In at least one embodiment, the plurality of electronic components include a first electronic component 213 and a second electronic component 215. The first electronic component 213 can be a telephone receiver and is disposed at another side of the keep-out-zone 211. The second electronic component 215 can be an earphone jack and is disposed in the notch 2112.

The holder 220 has a substantially rectangular shape and is configured to carry the antenna structure 100. In at least one embodiment, the holder 220 is mounted on the baseboard 210 to cover the keep-out-zone 211. Thus, the antenna structure 100 is located above the keep-out-zone 211, and will not be influenced by the other electronic components integrated on the baseboard 210.

The metallic frame 230 at least includes a first frame 231 and a second frame 232. The first frame 231 and the second frame 232 are positioned at two opposite ends of the baseboard 210. The second frame 232 defines a mounting hole 233 corresponding to the second electronic component 215 to allow a plug of an earphone (not shown) to insert into the second electronic component 215 via the mounting hole 233.

The cover 240 engages with the metallic frame 230 to accommodate the baseboard 210. In at least one embodiment, the cover 240 includes two first plates 241 and a second plate 242 which can be integrated with the two first plates 241 or can be latched with two first plates 241. The first plate 241 can be made of nonmetal materials, such as plastic, glass, wood, or leather. The second plate 242 can be made of metal or can be formed by coating a metal film on nonmetal materials. In at least one embodiment, the two first plates 241 are rectangular shapes and are connected to two opposite ends of the second plate 243, and the two first plate 241 are configured to coupled to a front cover (not shown) of the wireless communication device 200.

Figure 2:
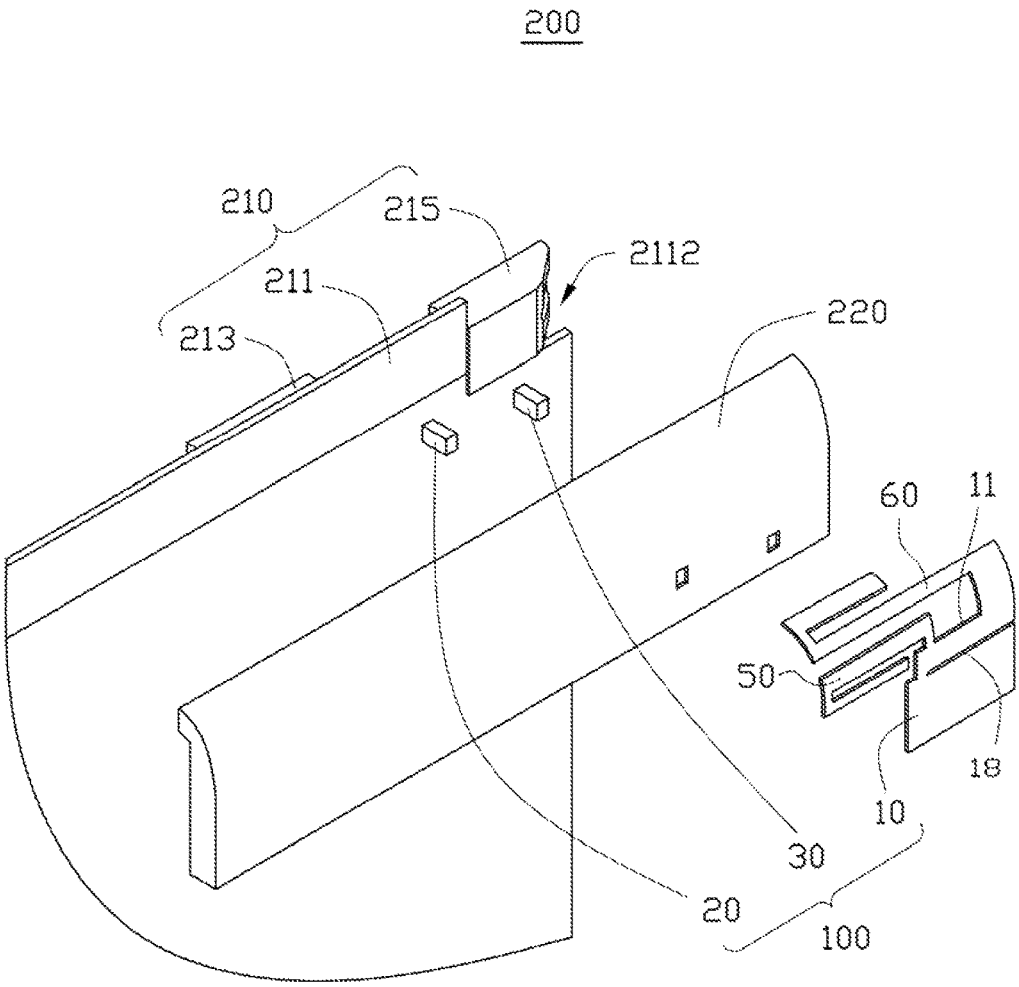
FIG. 2 is a partial diagrammatic view of the wireless communication device in FIG. 1.

Referring to FIG. 2, the antenna structure 100 can be a planar inverted-F antenna (PIFA) with two branches. In detail, the antenna structure 100 includes a matching portion 10, a feed portion 20, a ground portion 30, a first radiator 50, and a second radiator 60. The feed portion 20, the ground portion 30, the matching portion 10, and the first radiator 50 form one PIFA. The feed portion 20, the ground portion 30, the matching portion 10, and the second radiator 60 form another PIFA.

The matching portion 10 has a substantially rectangular shape and includes a first edge 11. The first radiator 50 and the second radiator 60 respectively extend from the two ends of the first edge 11. The feed portion 20 has a substantially columnar shape, a first end of the feed portion 20 is connected to the matching portion 10, and a second end of the feed portion 20 passes through the holder 220 to be electronically coupled to a feed pin (not shown) of the baseboard 210 to receive current. The ground portion 30 has a substantially columnar shape, a first end of the ground portion 30 is connected to the matching portion 10, and a second end of the ground portion 30 passes through the holder 220 to be electronically coupled to a ground pin (not shown) of the baseboard 210 to ground the antenna structure 100.

Figure 3:
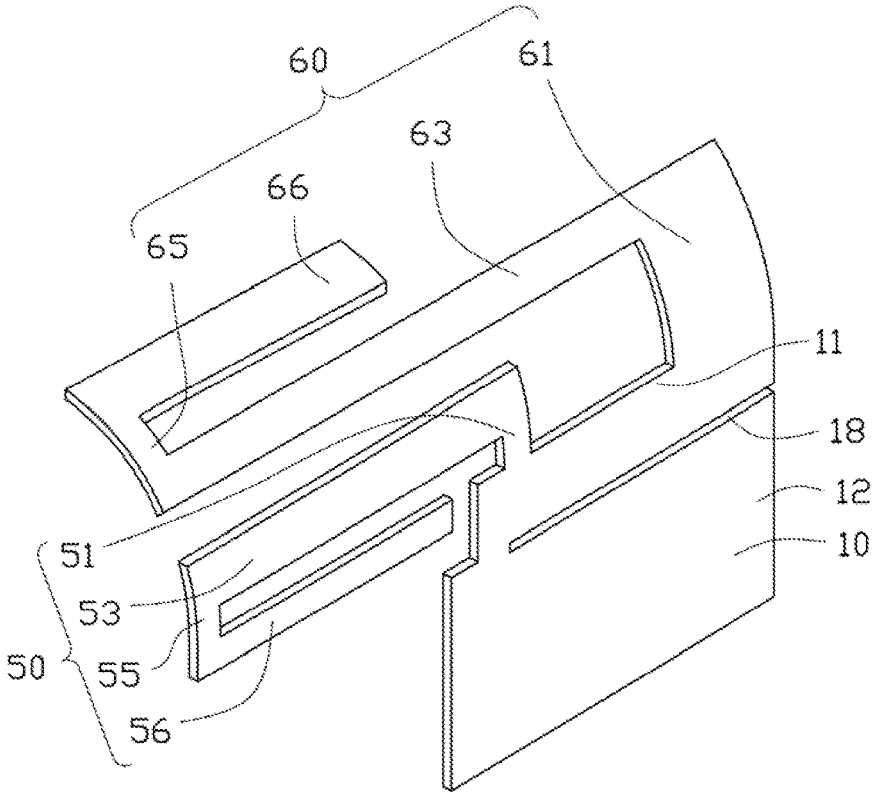
FIG. 3 is a diagrammatic view of the antenna structure in FIG. 1.
Figure 4A:
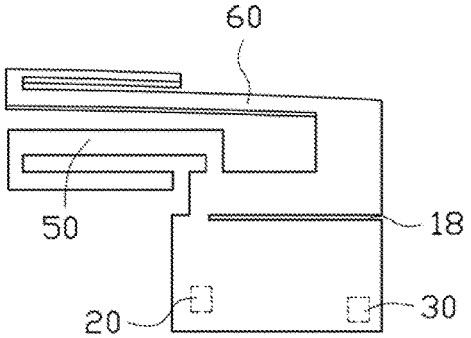
FIGS. 4A-4D each illustrates a diagrammatic view of the antenna structure in FIG. 3, while each antenna structure of FIG. 4A-4D defines a slot, and the four slots have different lengths.
Figure 4B:
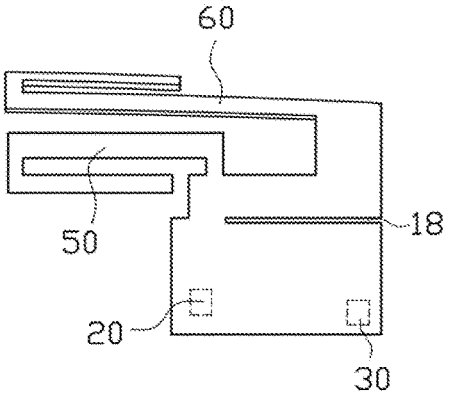
Figure 4C:
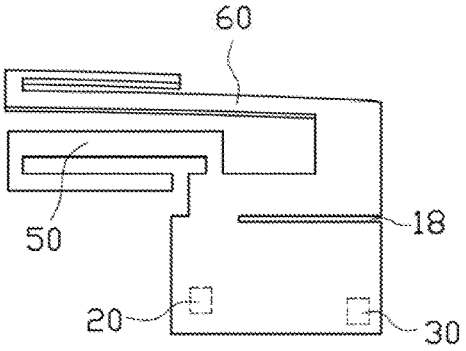
Figure 4D:
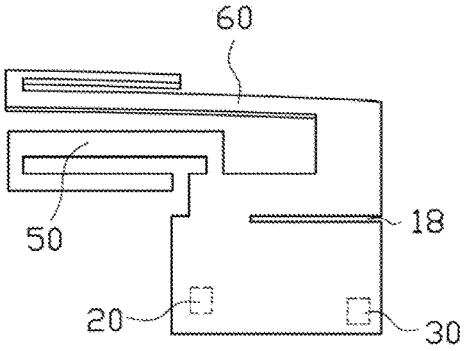

FIG. 3 illustrates that the first radiator 50 includes a first radiation section 51, a second radiation section 53, a third radiation section 55, and a fourth radiation section 56 connected in that order. The first radiation section 51 is substantially and perpendicularly connected to a first end of the first edge 11 of the matching portion 10. The second radiation section 53 is perpendicularly connected to the first radiation section 51 and extends away from the matching portion 10. The third radiation section 55 is perpendicularly connected to one end of the second radiation section 53 away from the first radiation section 51 and is parallel to the first radiation section 51. The fourth radiation section 56 is perpendicularly connected to one end of the second radiation section 53 away from the third radiation section 55 and is parallel to the second radiation section 53 and extends towards the matching portion 10. Then, the first radiator 50 forms substantially a loop structure with one open (not labeled).

The second radiator 60 includes a first connection section 61, a second connection section 63, a third connection section 65, and a fourth connection section 66 connected in that order. The first connection section 61 is perpendicularly connected to a second end of the first edge 11 of the matching portion 10 and extends parallel to the first radiation section 51. The second connection section 63 is perpendicularly connected to one end of the first connection section 61 away from the first edge 11 of the matching portion 10 and extends parallel to the second radiation section 53. The third connection section 65 is perpendicularly connected to one end of the second connection section 63 away from the first connection section 61 and extends away from the second radiation section 53. The third connection section 65 is parallel to the first connection section 61. The fourth connection section 66 is perpendicularly connected to one end of the third connection section 65 away from the second connection section 63 and extends towards the first connection section 61. The fourth connection section 66 is parallel to the second connection section 63. That is, the fourth connection section 66 and the second radiation section 53 are positioned at two sides of the second connection section 63, and the second radiator 60 forms substantially a S-shaped structure. Since the first radiator 50 and the second radiator 60 extend from a same side of the matching portion 10, and the third connection section 65 is substantially aligned with the third radiation section 55, which allows further size reductions of the wireless communication device 200 employing the antenna structure 100.

Optionally, the first radiator 50 and the second radiator 60 are positioned at one surface of the holder 220, and thus can be arcuate shaped sheets to facilitate installation on the holder 220. The curvature of the first radiator 50 and the second radiator 60 as a whole is the same as the curvature of the surface of the holder 220.

Figure 5A:
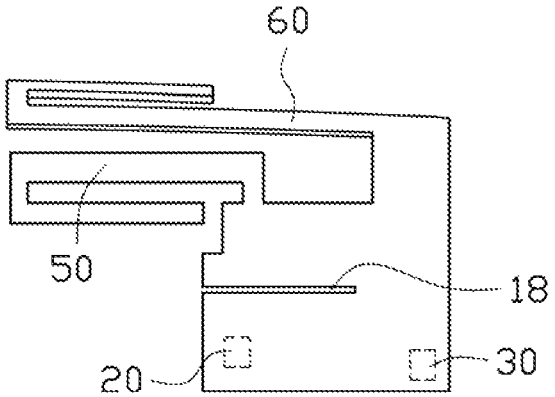
FIGS. 5A-5B each illustrates a diagrammatic view of the antenna structure in FIG. 3, while each antenna structure of FIG. 5A-5B defines a slot, and the two slots have different orientations.
Figure 5B:
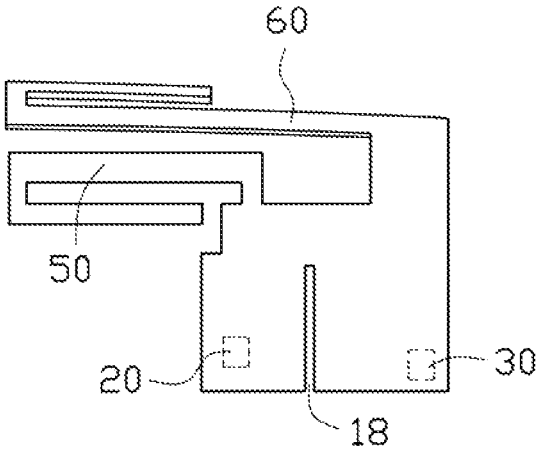

In addition, the antenna structure 100 further defines a slot 18 on the matching portion 10. In at least one embodiment, the slot 18 splits a second edge 12 of the matching portion 10 into two prongs, and is configured to change the flow of current on the antenna structure 100, thereby changing the mode of the antenna structure 100. In at least one embodiment, the second edge 12 is perpendicular to the first edge 11. Referring to FIGS. 4A-4D, each antenna structure 100 defines a slot 18, and the four slots 18 have different lengths. Referring to FIGS. 5A-5B, each antenna structure 100 defines a slot 18, and the two slots 18 have different orientations.

Figure 6:
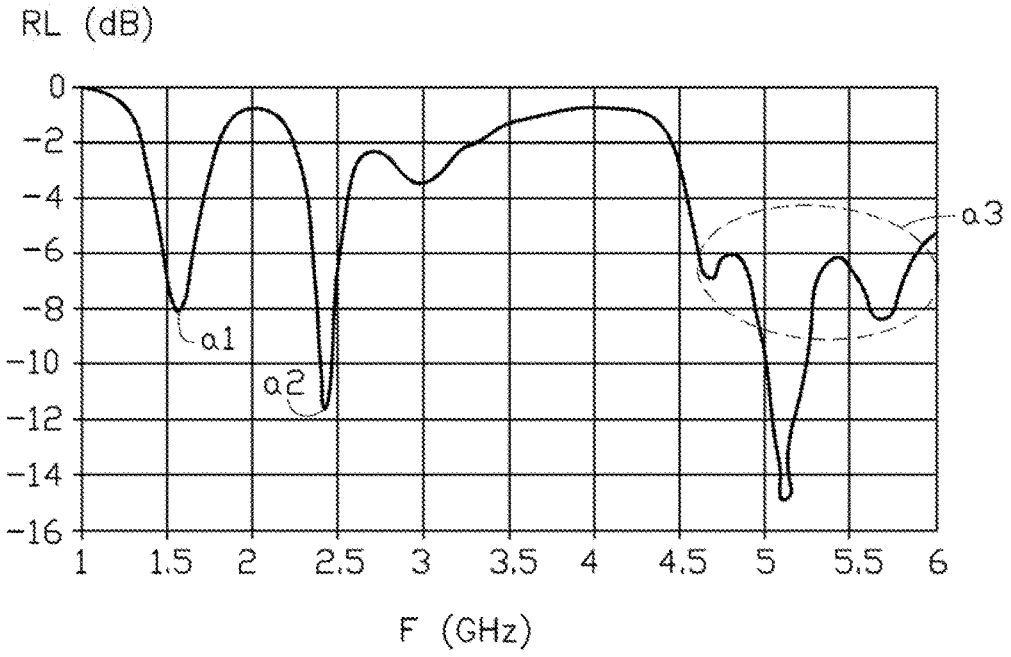
FIG. 6 is a return loss (RL) graph of the antenna structure in FIG. 3.

Now referring to FIG. 3 and FIG. 6, when the current is input to the feed portion 20, the current flows to the matching portion 10, the first connection section 61, the second connection section 63, the third connection section 65, and the fourth connection section 66 for resonating a first mode a1. The current also flows to the matching portion 10, the first radiation section 51, the second radiation section 53, the third radiation section 55, and the fourth radiation section 56 for resonating a second mode a2. In addition, the first radiator 50 generates a frequency-doubled effect and is coupled to the slot 18 for resonating a third mode a3.

Figure 8:
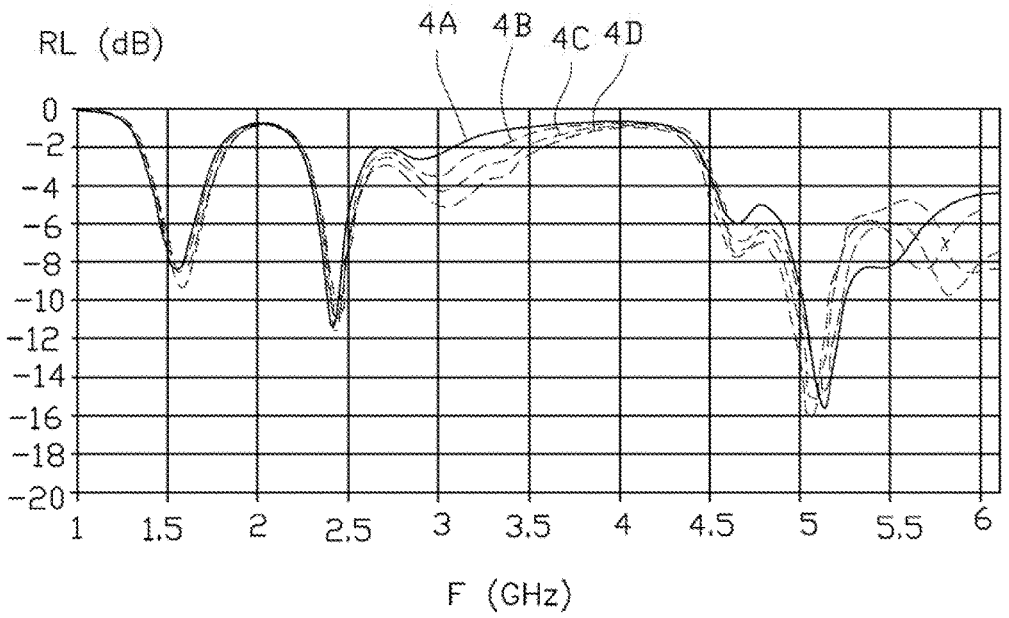
FIG. 8 is a return loss (RL) graph of the antenna structure in FIG. 4A-4D.

In addition, the third mode a3 can be fine-tuned by changing the length of the slot 18. Also referring the FIGS. 4A-4D and the FIG. 8, when the length of the slot 18 is reduced, the current path from the matching portion 10 to the first radiator 50 is increased. Thus, a central frequency of the third mode a3 is decreased.

Further, the second frame 232 can be coupled with the antenna structure 100 to broaden the bandwidth of the first mode a1, the second mode a2, and the third mode a3. In other embodiments, a matching circuit (not shown) can be cooperated into the wireless communication device 200 to broaden the bandwidth of the antenna structure 100.

Figure 7:
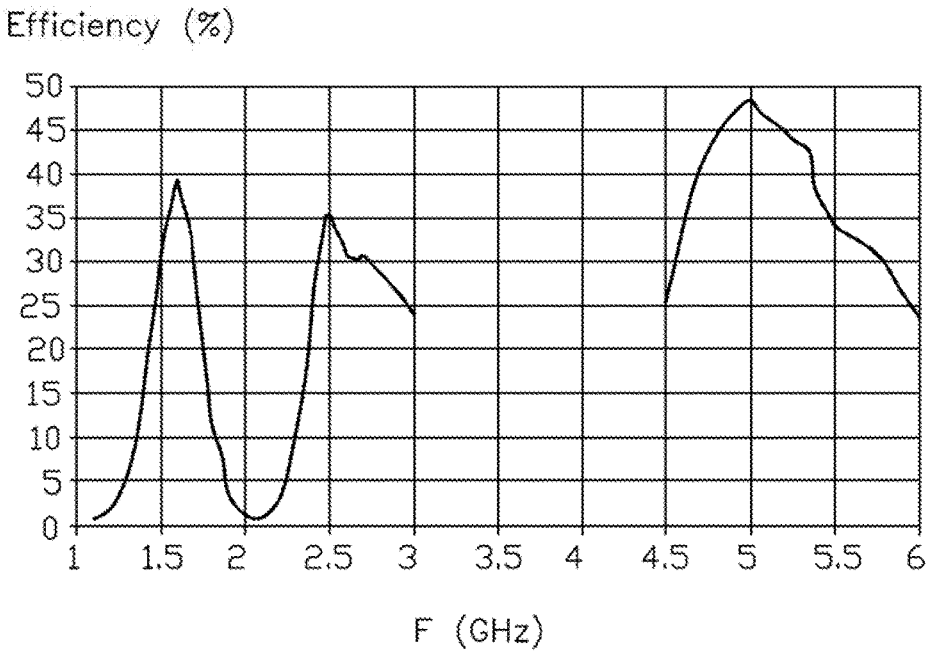
FIG. 7 is an antenna efficiency graph of the antenna structure in FIG. 3.

FIG. 7 illustrates an antenna efficiency of the antenna structure 100. In at least one embodiment, a central frequency of the first mode a1 is about 1.575 GHz which is activated to receive/transmit GPS signals, and an antenna efficiency of the first mode a1 is about 39%. A central frequency of the second mode a2 is about 2.4 GHz which is activated to receive/transmit WIFI signals, and an antenna efficiency of the second mode a2 is about 30%-35%. A central frequency of the third mode a3 is about 5.18 GHz-5.85 GHz which is activated to receive/transmit WIFI signals, and an antenna efficiency of the third mode a1 is about 30%-48%.

In summary, the antenna structure 100 includes the first radiator 50 and the second radiator 60 for receiving/transmitting different wireless signals, and the metallic frame 230 can be coupled with the antenna structure 100, which allows further size reductions of the wireless communication device 200 employing the antenna structure 100. In addition, a radiating capability of the antenna structure 100 of the wireless communication device 200 is effectively improved because the first radiator 50 can be coupled with the slot 18.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure used in a wireless communication device, the antenna structure comprising:

a matching portion having a first edge and a second edge and defining a slot splitting the second edge into two prongs, wherein the second edge is split by the slot into two flat edges to form the ends of the two prongs;

a first radiator extending from the first edge of the matching portion; and a second radiator extending from the first edge of the matching portion;

wherein the second radiator and the matching portion resonate a first mode, the first radiator and the matching portion resonate a second mode, and the slot, the first radiator, and the matching portion resonate a third mode;

wherein the second radiator comprises a first connection section, a second connection section, a third connection section, and a fourth connection section connected in that order, the first connection section is perpendicularly connected to a first end of the first edge of the matching portion, the second connection section is perpendicularly connected to the first connection section and extends parallel to the first edge of the matching portion, the third connection section is parallel to the first connection section, and the fourth connection section is parallel to the second connection section.

2. The antenna structure as claimed in claim 1, further comprising a feed portion and a ground portion, wherein the feed portion and the ground portion are both electrically connected to the matching portion, the feed portion, the ground portion, the matching portion, and the first radiator form one planar inverted-F antenna (PIFA), and the feed portion, the ground portion, the matching portion, and the second radiator form another PIFA.

3. The antenna structure as claimed in claim 2, wherein the first radiator comprises a first radiation section, a second radiation section, a third radiation section, and a fourth radiation section connected in that order.

4. The antenna structure as claimed in claim 3, wherein the first radiation section is perpendicularly connected to a second end of the first edge of the matching portion, the second radiation section is perpendicularly connected to the first radiation section and extends away from the matching portion, the third radiation section is parallel to the first radiation section, and the fourth radiation section is parallel to the second radiation section and extends towards the matching portion.

5. The antenna structure as claimed in claim 4, wherein the first connection section extends parallel to the first radiation section, the second connection section extends parallel to the second radiation section, and the third connection section is substantially aligned with the third radiation section.

6. The antenna structure as claimed in claim 4, wherein the fourth connection section and the second radiation section are positioned at two sides of the second connection section, the first radiator forms substantially a loop structure with one open, and the second radiator forms substantially a S-shaped structure.

7. A wireless communication device, comprising:

an antenna structure comprising:

a matching portion having a first edge and a second edge and defining a slot splitting the second edge into two prongs, wherein the second edge is split by the slot into two flat edges to form the ends of the two prongs;

a first radiator extending from the first edge of the matching portion; and a second radiator extending from the first edge of the matching portion;

wherein the second radiator and the matching portion resonate a first mode, the first radiator and the matching portion resonate a second mode, and the slot, the first radiator, and the matching portion resonate a third mode;

wherein the second radiator comprises a first connection section, a second connection section, a third connection section, and a fourth connection section connected in that order, the first connection section is perpendicularly connected to a first end of the first edge of the matching portion, the second connection section is perpendicularly connected to the first connection section and extends parallel to the first edge of the matching portion, the third connection section is parallel to the first connection section, and the fourth connection section is parallel to the second connection section.

8. The wireless communication device as claimed in claim 7, wherein the antenna structure further comprises a feed portion and a ground portion, wherein the feed portion and the ground portion are both electrically connected to the matching portion, the feed portion, the ground portion, the matching portion, and the first radiator form one planar inverted-F antenna (PIFA), and the feed portion, the ground portion, the matching portion, and the second radiator form another PIFA.

9. The wireless communication device as claimed in claim 8, wherein the first radiator comprises a first radiation section, a second radiation section, a third radiation section, and a fourth radiation section connected that order.

10. The wireless communication device as claimed in claim 9, wherein the first radiation section is perpendicularly connected to a second end of the first edge of the matching portion, the second radiation section is perpendicularly connected to the first radiation section and extends away from the matching portion, the third radiation section is parallel to the first radiation section, and the fourth radiation section is parallel to the second radiation section and extends towards the matching portion.

11. The wireless communication device as claimed in claim 10, wherein the first connection section extends parallel to the first radiation section, the second connection section extends parallel to the second radiation section, and the third connection section is substantially aligned with the third radiation section.

12. The wireless communication device as claimed in claim 10, wherein the fourth connection section and the second radiation section are positioned at two sides of the second connection section, the first radiator forms substantially a loop structure with one open, and the second radiator forms substantially a S-shaped structure.

13. The wireless communication device as claimed in claim 7, further comprising a metallic frame and a baseboard latched by and electrically connected to the metallic frame, wherein the baseboard defines a keep-out-zone, the antenna structure is located above a side of the keep-out-zone.

14. The wireless communication device as claimed in claim 13, further comprising a holder, wherein the holder is mounted on the baseboard to cover the keep-out-zone, the antenna structure is carried by the holder.

* * * * *